US007024893B2

(12) United States Patent
Dort et al.

(10) Patent No.: US 7,024,893 B2
(45) Date of Patent: Apr. 11, 2006

(54) DURABLE KNITTED NET

(75) Inventors: Thomas Dort, Wichita, KS (US); James Flick, Wichita, KS (US); Mike DeWeese, Kingman, KS (US); Lyndie Henrie, Kaysville, UT (US); Dennis Gregory McCabe, Kingman, KS (US); Paul Schmidt, Pretty Prairie, KS (US); Nick Carter, Mooresville, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 10/971,415

(22) Filed: Oct. 22, 2004

(65) Prior Publication Data

US 2005/0183468 A1 Aug. 25, 2005

Related U.S. Application Data

(60) Provisional application No. 60/513,278, filed on Oct. 22, 2003.

(51) Int. Cl.
*D04B 21/10* (2006.01)

(52) U.S. Cl. ..... 66/195

(58) Field of Classification Search ..... 66/195, 66/196, 192, 193; 442/312, 313
See application file for complete search history.

(56) References Cited

U.S. PATENT DOCUMENTS

| | | | | |
|---|---|---|---|---|
| 3,949,043 | A | 4/1976 | Jauer et al. | |
| 4,285,898 | A | 8/1981 | Hoppe et al. | |
| 4,569,439 | A | 2/1986 | Freye et al. | |
| 4,570,789 | A | 2/1986 | Fritz et al. | |
| 5,104,714 | A * | 4/1992 | Leiber et al. | 66/202 |
| 5,458,957 | A * | 10/1995 | Fryszer et al. | 66/169 R |
| 5,635,298 | A | 6/1997 | Delker | |
| 5,869,180 | A | 2/1999 | Budenbender et al. | |
| 6,141,993 | A * | 11/2000 | Whitbeck | 66/195 |
| 6,250,117 | B1 * | 6/2001 | Wunner | 66/195 |
| 6,399,523 | B1 * | 6/2002 | Matsumoto | 66/195 |
| 6,477,865 | B1 * | 11/2002 | Matsumoto | 66/195 |
| 6,521,551 | B1 * | 2/2003 | Mass et al. | 442/312 |
| 6,630,414 | B1 * | 10/2003 | Matsumoto | 66/195 |
| 6,840,067 | B1 * | 1/2005 | Mass et al. | 66/203 |

FOREIGN PATENT DOCUMENTS

EP 0723606 4/1996

* cited by examiner

*Primary Examiner*—Danny Worrell
(74) *Attorney, Agent, or Firm*—Wood, Phillips, Katz, Clark & Mortimer

(57) ABSTRACT

The present invention is directed to a net, and more specifically to a knitted net comprising a plurality of chain and fill yarns comprising mono-filaments that decreases the overall mass of the net, yet increases the durability of the net. In accordance with the present invention, the netting is used as bale wrap.

10 Claims, 3 Drawing Sheets

DURABLE KNITTED NET

This application claims benefit of Provisional Application No. 60/513,278, filed Oct. 22, 2003.

TECHNICAL FIELD

The present invention generally relates to a net, and more specifically to a knitted net comprising a plurality of chain yarns and/or fill yarns comprising mono-filaments that decreases the overall mass of the net, yet increases the durability of the net.

BACKGROUND OF THE INVENTION

Netting is often prepared either by knitting, weaving, or extrusion. Knitted netting typically comprises a plurality of threads oriented in a first direction and being essentially equal spaced from one another, and having wefts oriented in a second direction which is perpendicular to the first direction, the threads and wefts being interlocked and secured. Nets may be prepared by a Raschel knitting method, a process in which the threads are attached to knitting elements that comprise two needles and knock-over comb bars positioned opposite to one another, and comprising ground guide bars, pattern guide bars and stitch comb bars. An example of such a knitted net is described in European Patent No. 0 723 606, to Fryszer, et al., incorporated herein by reference.

Knitted netting has a variety of end use applications, including but not limited to hay bale wrap, cargo wrap, netted bags, and drainage nets. Raschel knitted nets have been used for round hay bale wrapping as disclosed in U.S. Pat. Nos. 4,569,439 and No. 4,570,789, both hereby incorporated by reference. Twines and films have also been used to tie up hay bales; however the twine usually cuts in the bale and doesn't provide ample support to keep the bale tidy and neat. Further, the twining of the rolled bales with the binding yarn is relatively time-consuming and requires substantial manual labor. Film covers don't allow the rolled bale enough air circulation, which lead to the growth of mold and eventually rotting. The Raschel knitted net doesn't cut into the hay bale and allows ample amount of air to circulate through the bale; however Raschel knitted nets typically comprise conventional yarns that add to bulk of the net.

A need remains for a less bulky knitted net, which utilizes less polymer and has improved durability. Further, the net may be used as bale wrap, withstanding the handling forces of heavy machinery, such as the pick-up and transport of the rolled bales.

SUMMARY OF THE INVENTION

The present invention is directed to a net, and more specifically to a knitted net comprising a plurality of chain and fill yarns comprising mono-filaments that decreases the overall mass of the net, yet increases the durability of the net.

In accordance with the present invention, the netting is used as bale wrap. The bale wrap comprises a plurality of chain yarns orientated in a first direction and a plurality of fill yarns orientated in a second direction. The chain and/or fill yarns are comprised entirely or partly of mono-filaments. Mono-filaments can be drawn to a finer denier than conventional yarns and diminish the bulk of the net. Despite the finer denier, the use of mono-filaments in knitted nets contributes to the overall strength and durability of the net.

Using more than one mono-filament in a single yarn further improves the strength of the net by compounding the filament's attributes.

In addition to mono-filaments, the yarns of the present invention may comprise flat filaments, such as tapes, or a combination of tapes and filaments. The filaments may be of similar or dissimilar polymeric compositions. Suitable filaments, which may be blended in whole or part with natural or synthetic polymeric compositions, include polyamides, polyesters, polyolefins, polyvinyls, polyacrylics, and the blends or coextrusion products thereof. The synthetic polymers may be further selected from homopolymers; copolymers, conjugates and other derivatives including those thermoplastic polymers having incorporated melt additives or surface-active agents, as well as elastomeric polymers.

It's in the purview of the present invention that the mono-filament yarns may be selectively placed throughout the net. For instance, it has been contemplated that the chain yarns located proximal to the outer edges comprise less mono-filaments compared to those chain yarns located distal to the outer edges of the net. Further, the chain yarns located proximal to the outer edges may be completely lacking in mono-filaments, whereas the chain yarns located distal to the outer edges comprise a plurality of chain yarns. The absence and presence of mono-filament chain yarns throughout the net can establish specific zones within the net. A zone is defined as an area within the netting that is comprised of more than one chain yarn and more than one fill yarn, whereby the chain yarns share similarities. The netting may be comprised of two or more zones. Further, the yarns of one zone may comprise similar or dissimilar yarns than that of a second zone. Further still, the yarns of one zone may comprise similar or dissimilar topical or internal additives than that of a second zone.

DETAILED DESCRIPTION

While the present invention is susceptible of embodiment in various forms, there will hereinafter be described, presently preferred embodiments, with the understanding that the present disclosure is to be considered as an exemplification of the invention, and is not intended to limit the invention to the specific embodiments disclosed herein.

In accordance with the present invention, the durable knit is formed on a Raschel knitting machine. The machine comprises a plurality of latch needles, a plurality of lapping belts, a yarn laying-in comb and a plurality of guide bars having needle guides thereon. The latch needles are mounted in the machine to carry out a reciprocating motion in a given plane while the lapping belts are spaced from the needles on one side of the plane, i.e. on a downstream side, for guiding pattern yarns to the needles. In addition, the laying-in comb is mounted on the same side of the plane of the latch needles as the lapping belts and carries out an orbital motion perpendicularly of the plane of the latch needles to penetrate between the pattern yarns. The guide bars with the needle guides serve to lay-in stitch yarns and are mounted on an opposite side of the plane of the latch needles from the lapping belts, i.e. on the upstream side, and oscillate at an angle to the pattern yarns.

Figure 1:
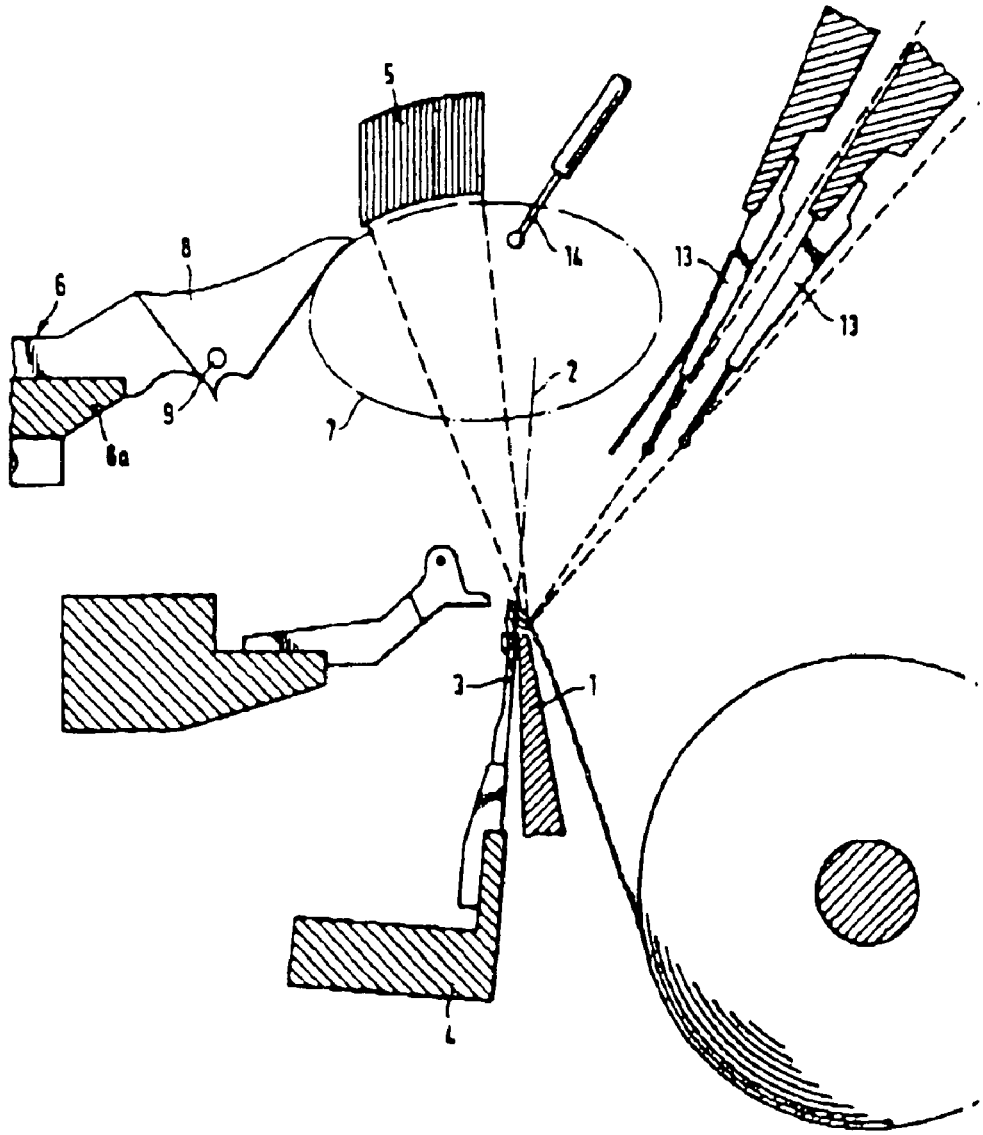
FIG. 1 illustrates a view of a portion of a Raschel machine.

FIG. 1, is representative of a Raschel machine, whereby it is provided with a comb plate 1 in which a plurality of latch needles 3 are mounted for reciprocating motion along their axes 2 in a vertical plane, as viewed. As shown, the needles 3 are disposed on a bar 4 which is movable up and down.

In addition, the machine includes a plurality of lapping belts or guide bars 5 spaced from the needles 3 on one side, i.e. the downstream side, of the plane of the needles 3 for guiding pattern yarns to the needles 3. A yarn laying-in comb 6 is also mounted on the same side of the plane 2 of the latch needles 3 in order to carry out an orbital motion perpendicularly of the plane 2 while penetrating between the pattern yarns. As indicated in chain-dotted line 7, the orbital motion is a combined stroke and oscillating motion. The comb 6 is provided with a plurality of parallel sinkers 8 each of which carries a guide rod 9 and which has a deflecting edge 10 at the forward end extending towards the plane 2. In addition, each sinker 8 has a yarn catch 11 at a lower region of the deflecting edge 10 below the guide rod 9. A trace comb 12 is also mounted over the comb plate 1 in known manner.

The machine also has a plurality of guide bars 13 which have needle guides thereon for directing stitch yarns to the latch needles 3. As shown, the guide bars 13 are mounted on the side of the plane 2 of the latch needles 3 opposite the lapping belts 5, i.e. on the upstream side. Suitable means are also provided for oscillating the guide bars 13 at an angle to the pattern yarns.

As shown in FIG. 1, the lapping belts 5 are positioned at an acute angle downstream of the plane 2. A yarn guide 14 is also disposed between the belts 5 and the guide bars 13 for deflecting the pattern yarns upon laying-in of the stitch yarns. This yarn guide 14 is used for laying the pattern yarns in the needle lanes (not shown). The yarn guide 14 may be coupled to the guide bars 13 so as to move therewith or may be provided with an independent drive (not shown).

The netting of the present invention is knitted on such a machine, wherein a plurality of mono-filament chain yarns are orientated in a first direction and a plurality of fill yarns are orientated in a second direction. Alternatively, the chain yarns, as well as the fill yarns may comprise mono-filaments. Various mono-filaments may be utilized within the durable net of the present invention. Unlimiting examples of such mono-filaments include bicomponent, striated, coated, abrasion resistant, and high tenacity mono-filaments. U.S. Pat. Nos. 3,949,043; 4,285,898; 5,635,298; and 5,869,180, hereby incorporated by reference, are representative of the various mono-filaments that may be incorporated into the present invention.

It is within the purview of the invention that the net comprise zones, wherein chain yarns may be selectively arranged throughout the net. For instance chain yarns located proximal to the outer edges may comprise less mono-filaments compared to those chain yarns located distal to the outer edges of the net. Further, the chain yarns located proximal to the outer edges may be completely lacking in mono-filaments, whereas the chain yarns located distal to the outer edges comprise a plurality of mono-filaments. The yarns are interconnected with fill yarns orientated in a second direction on a Raschel machine forming a net, wherein the net utilizes a decreased amount of polymer while retaining its strength and durability.

Figure 2:
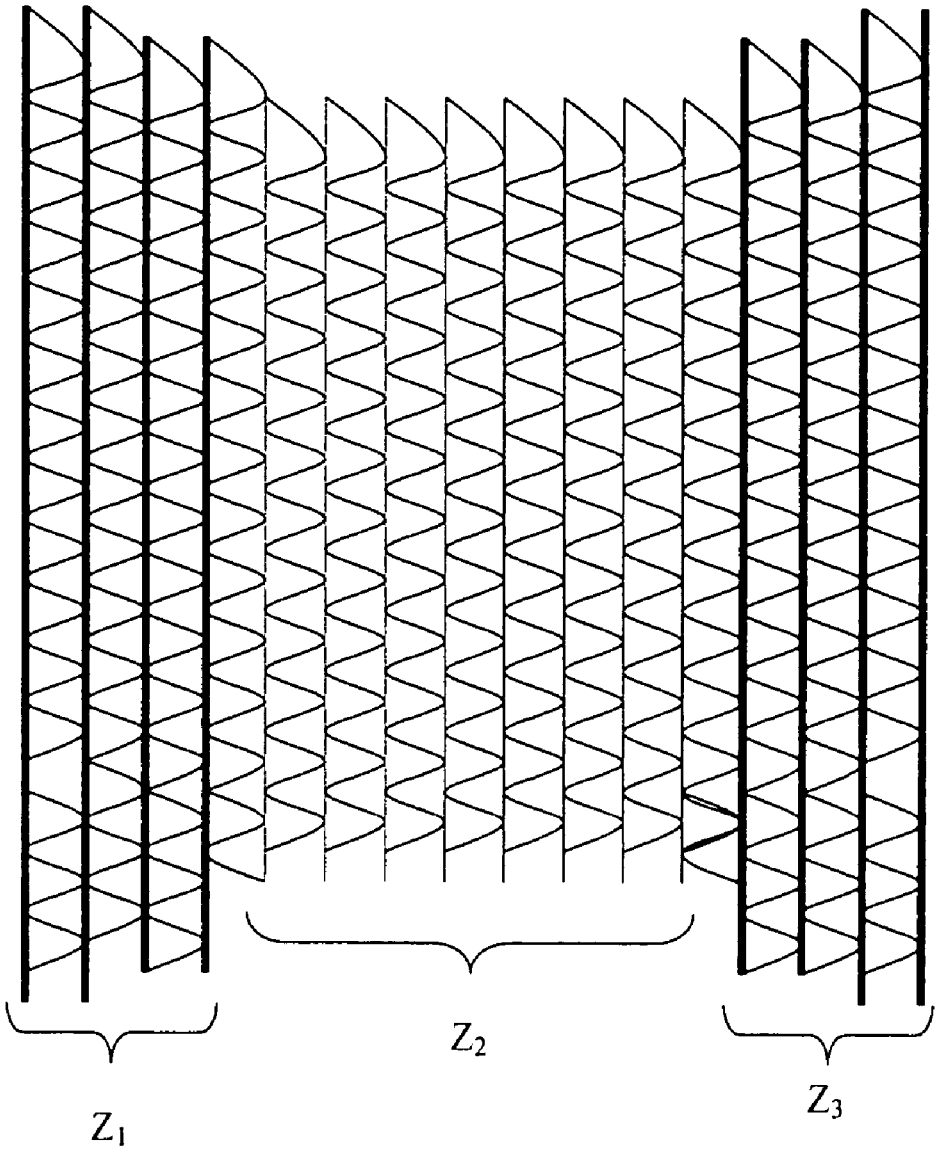
FIG. 2 is a representation of the zones within the net of the present invention.
Figure 3:
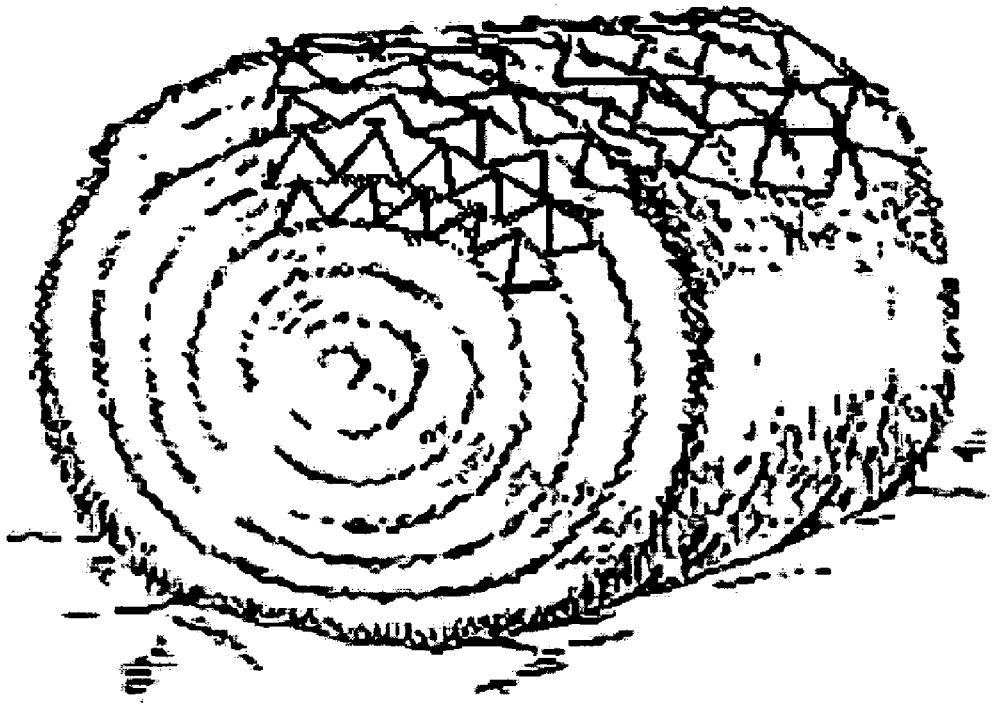
FIG. 3 is a diagrammatic view of the netting partially wrapped about a rounded bale.

Referring to FIG. 2 therein is a diagrammatic representation of the knitted net of the present invention. The net of FIG. 2 comprises three zones, wherein zone one ($Z_1$) comprises less mono-filaments than zone two ($Z_2$) and zone three ($Z_3$) comprises less mono-filaments than zone two ($Z_2$). FIG. 4 demonstrates how the expandable net fits around the bale to keep it compact and neat.

Subsequent to formation, the knitted net material may optionally be subjected to various chemical and/or mechanical post-treatments. The net material is then collected and packaged in a continuous form, such as in a roll form, or alternatively, the net material may comprise a series of weak points whereby desired lengths of twine material may be detracted from the remainder of the continuous packaged form.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making a durable knitted net comprising the steps of:

a. providing chain yarns orientated in a first longitudinal direction, wherein said chain yarns comprise one or more mono-filaments;

b. providing fill yarns orientated in a second direction generally transverse to said first direction;

c. interconnecting said chain yarns and said fill yarns on a Raschel machine forming a durable netting, wherein lateral-most ones of said chain yarns generally define opposite outer edges of said net, and wherein at least some of said chain yarns distal said outer edges include a greater number of said mono-filaments than those ones of said chain yarns proximal said outer edges.

2. A method of making a durable knitted net as in claim 1, wherein said fill yarns comprise mono-filaments.

3. A method of making a durable knitted net comprising the steps of:

a. providing chain yarns orientated in a first longitudinal direction b. providing fill yarns orientated in a second direction generally transverse to said first direction;

c. arranging said chain yarns into a first longitudinally extending zone;

d. arranging said chain yarns comprising said one or more mono-filaments into a second longitudinally extending zone spaced laterally of said first zone; and e. interconnecting said chain yarns and said fill yarns on a Raschel machine forming a durable netting, f. wherein the chain yarns of said first zone exhibit properties which differ from the chain yarns of said second zone.

4. A method of making a durable knitted net as in claim 1, wherein said yarns are selected from the group consisting of polyamides, polyesters, polyolefins, polyvinyls, polyacrylics, and the combinations thereof.

5. A method of making a durable knitted net as in claim 4, wherein said yarns are polymeric tapes, filaments, or a combination thereof.

6. A method of making a durable knitted net as in claim 3, wherein said net is comprised of at least three longitudinally extending zones.

7. A method of making a durable knitted net as in claim 1, wherein said net comprises a post-treatment.

8. A method of making a durable knitted net as in claim 1, wherein said fill yarns are elastomeric.

9. A durable knitted net comprising chain yarns of one or more mono-filaments orientated in a first longitudinal direction and fill yarns orientated in a second direction generally transverse to said first direction, wherein said chain yarns and fill yarns are interconnected on a Raschel machine forming a durable netting, wherein lateral-most ones of said chain yarns generally define opposite outer edges of said net, and wherein at least some of said chain yarns distal said outer edges include a greater number of said mono-filaments than those ones of said chain yarns proximal said outer edges.

10. A durable knitted net comprising first, second, and third longitudinally extending zones, said first zone and said third zone are respectively located proximal to opposite outer edges of said net; said second zone is located intermediate said first and third zones; said first and third zones comprise less mono-filaments than said second zone.

* * * * *